US011400359B2

(12) United States Patent
Lin

(10) Patent No.: US 11,400,359 B2
(45) Date of Patent: Aug. 2, 2022

(54) MOUTHGUARD WITH LIGHT EMITTING FUNCTION

(71) Applicant: Lian Hsing Plastic Industrial Co., Ltd., Taichung (TW)

(72) Inventor: Chien-Hsing Lin, Taichung (TW)

(73) Assignee: LIAN HSING PLASTIC INDUSTRIAL CO., LTD., Taichung (TW)

( * ) Notice: Subject to any disclaimer, the term of this patent is extended or adjusted under 35 U.S.C. 154(b) by 337 days.

(21) Appl. No.: 16/819,905

(22) Filed: Mar. 16, 2020

(65) Prior Publication Data

US 2021/0283490 A1 Sep. 16, 2021

(51) Int. Cl.

| | |
|---|---|
| ***A63B 71/00*** | (2006.01) |
| ***A63B 71/08*** | (2006.01) |
| ***H05B 47/10*** | (2020.01) |

(52) U.S. Cl.

CPC ..... *A63B 71/085* (2013.01); *H05B 47/10* (2020.01); *A63B 2225/74* (2020.08)

(58) Field of Classification Search

CPC .... A63B 71/085; A63B 2225/74; H05B 47/10
See application file for complete search history.

(56) References Cited

U.S. PATENT DOCUMENTS

| | | | | |
|---|---|---|---|---|
| 11,179,104 | B2 * | 11/2021 | Gonzales | B29C 51/12 |
| 2009/0122525 | A1 * | 5/2009 | DeLeeuw | F21V 23/0414 362/103 |
| 2020/0147473 | A1 * | 5/2020 | Maloney | A63B 71/085 |

* cited by examiner

*Primary Examiner* — Gerald J Sufleta, II

(74) *Attorney, Agent, or Firm* — Muncy, Geissler, Olds & Lowe, P.C.

(57) ABSTRACT

The present invention discloses a mouthguard with light emitting function. The mouthguard with light emitting function includes an occlusion unit which is bitten by teeth between the maxilla and the mandible of a wearer. A front end of the occlusion unit is provided with a protector which includes a holding chamber. The mouthguard also includes a lower cap, which is disposed in the holding chamber of the protector; an electric module, which is disposed in the lower cap and includes a control circuit, light emitting devices and a push button; and an upper cap, which covers the electric module to clip and fix with the lower cap. By pressing the push button, the light emitting devices are activated to emit light, thereby achieving the effect of alerting and highlighting.

5 Claims, 7 Drawing Sheets

MOUTHGUARD WITH LIGHT EMITTING FUNCTION

BACKGROUND OF THE INVENTION a) Field of the Invention

The present invention relates to a mouthguard with light emitting function, and more particularly to a mouthguard that protects a wearer's incisors and is provided with a light emitting function at a same time.

b) Description of the Prior Art

A sport brace is used primarily to protect the incisors; when a jaw is hit, the sport brace can absorb part of impact force and protect the mandibular joint as well. Therefore, in the past, the sport braces are used frequently in the sports with a strong impact force, such as boxing, wrestling or Taekwondo.

However, as the continuous increase in the consciousness of self-protection, athletes will start using the sport braces while doing the sports in which their heads may be impacted. In addition, there are even studies abroad showing that when the athletes wear the sport braces, their performance will improve. It is speculated that when the athletes use their muscle power instantaneously, the teeth will create a strong occlusion force as well, and the soft materials in the sport braces can buffer the occlusion force to achieve the effect of stress relaxation.

The conventional braces are only capable of protecting the athletes' teeth, and if there are other usages when the athletes bite the braces, the practicality of the braces will be increased significantly.

Accordingly, there are still some shortcomings in the abovementioned conventional braces, which are indeed not a good design and thus need improvement badly.

SUMMARY OF THE INVENTION

Therefore, the primary object of the present invention is to provide a mouthguard that protects a wearer's incisors and is provided with a light emitting function at a same time.

To achieve the abovementioned object, the mouthguard with light emitting function, according to the present invention, comprises an occlusion unit which provides for biting by teeth between the maxilla and the mandible of a wearer. A front end of the occlusion unit is extended with a protector, and the protector is provided with a holding chamber.

The mouthguard with light emitting function also includes a lower cap which is disposed in the holding chamber of the protector, and is provided with a fixing hole to accommodate a battery; an electric module which is disposed in the lower cap and includes a control circuit, a light emitting device, a push button and a battery chamber; an upper cap which covers the electric module to clip and fix with the lower cap; a battery which is disposed in the battery chamber; and a battery cover which fixes the battery in the battery chamber and enables the battery to provide electricity needed by the electric module.

After the wearer bites on the occlusion unit, he or she can breathe through a respiration opening in the occlusion unit, and can even press the push button to activate the light emitting device in the electric module to emit light, thereby achieving the effect of alerting and highlighting.

The protector and the lower cap at a front end of the occlusion unit, according to the present invention, are provided respectively with a pressing part and an elastic button which are disposed relative to the push button in the electric module, so that the wearer can press the pressing part of the protector to control the light emitting device.

In the present invention, the upper cap and the lower cap are combined and fixed together by ultrasonic welding.

The biggest difference between the present invention and a conventional mouthguard is that the conventional mouthguard can only provide the biting protection for the wearer, without any other application. Whereas, in addition to that the mouthguard of present invention can provide the biting protection for the wearer, the mouthguard is further provided with the light emitting device to achieve the effect of alerting.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

For the examiners to better understand the abovementioned and other objects, the technical features, and the advantages of the present invention, the present invention is hereinafter described in details with a preferred embodiment and the accompanying drawings.

Figure 1:
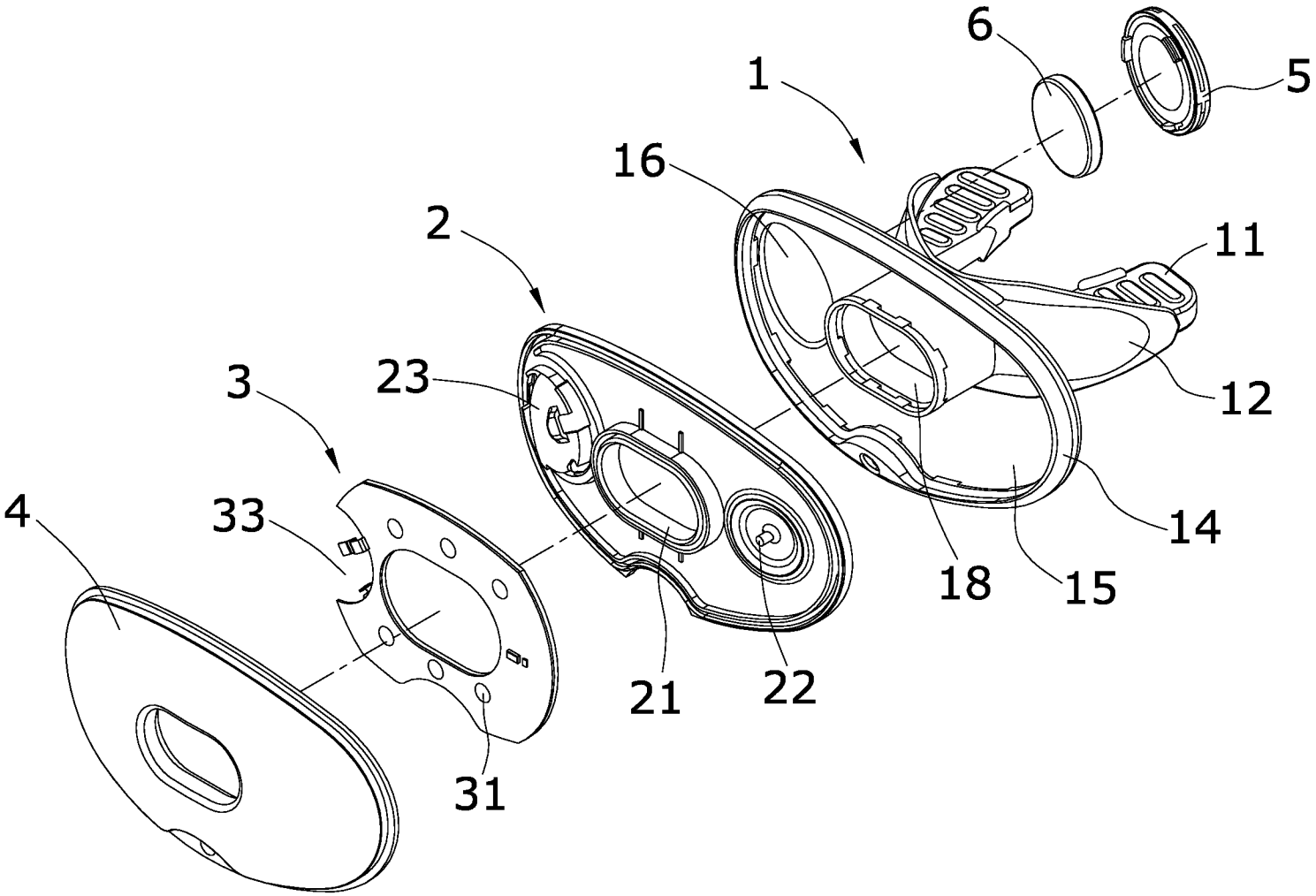
FIG. 1 shows an exploded view of a mouthguard with light emitting function, according to the present invention.
Figure 2:
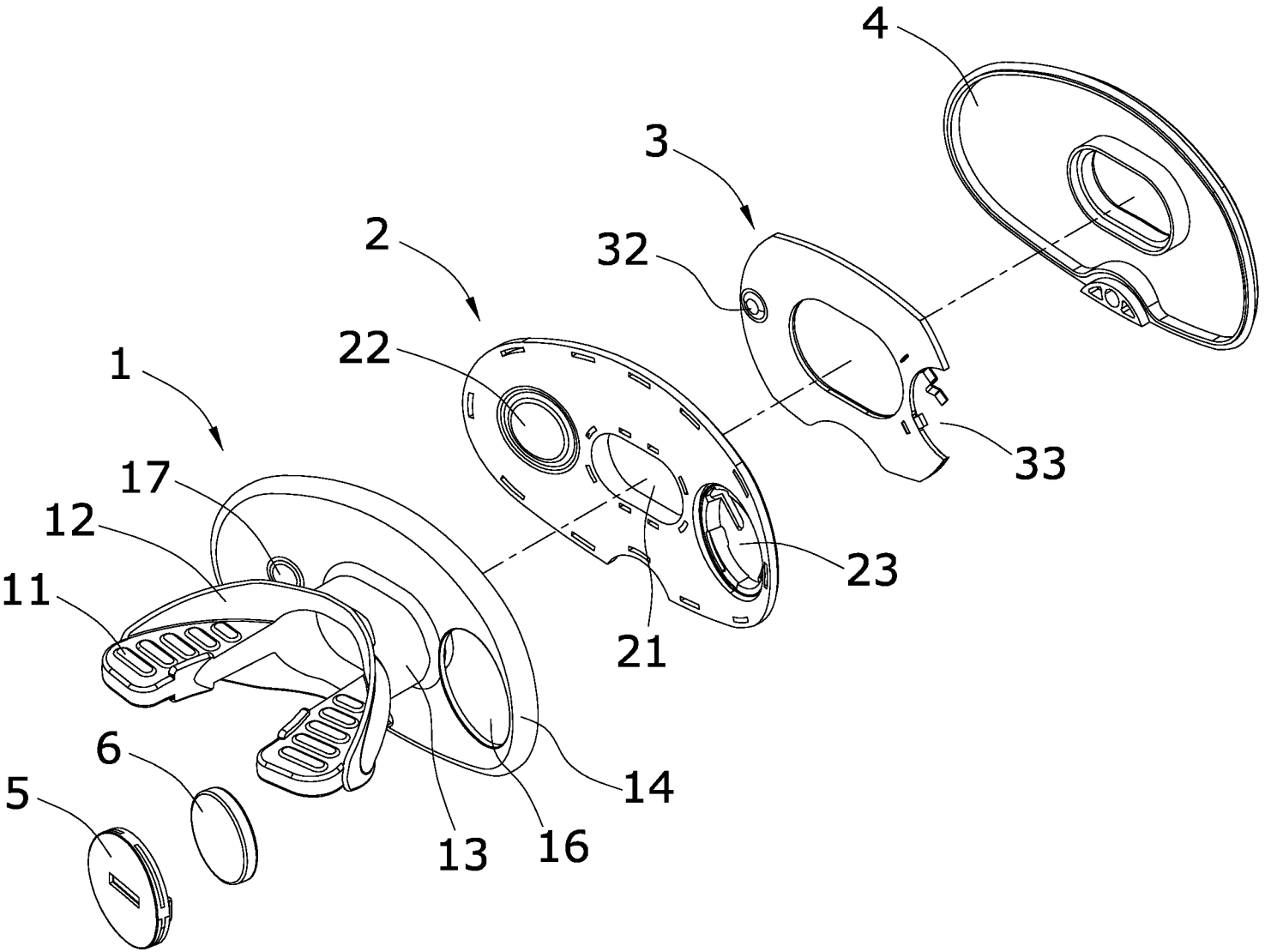
FIG. 2 shows an exploded view of the mouthguard with light emitting function from another angle, according to the present invention.
Figure 3:
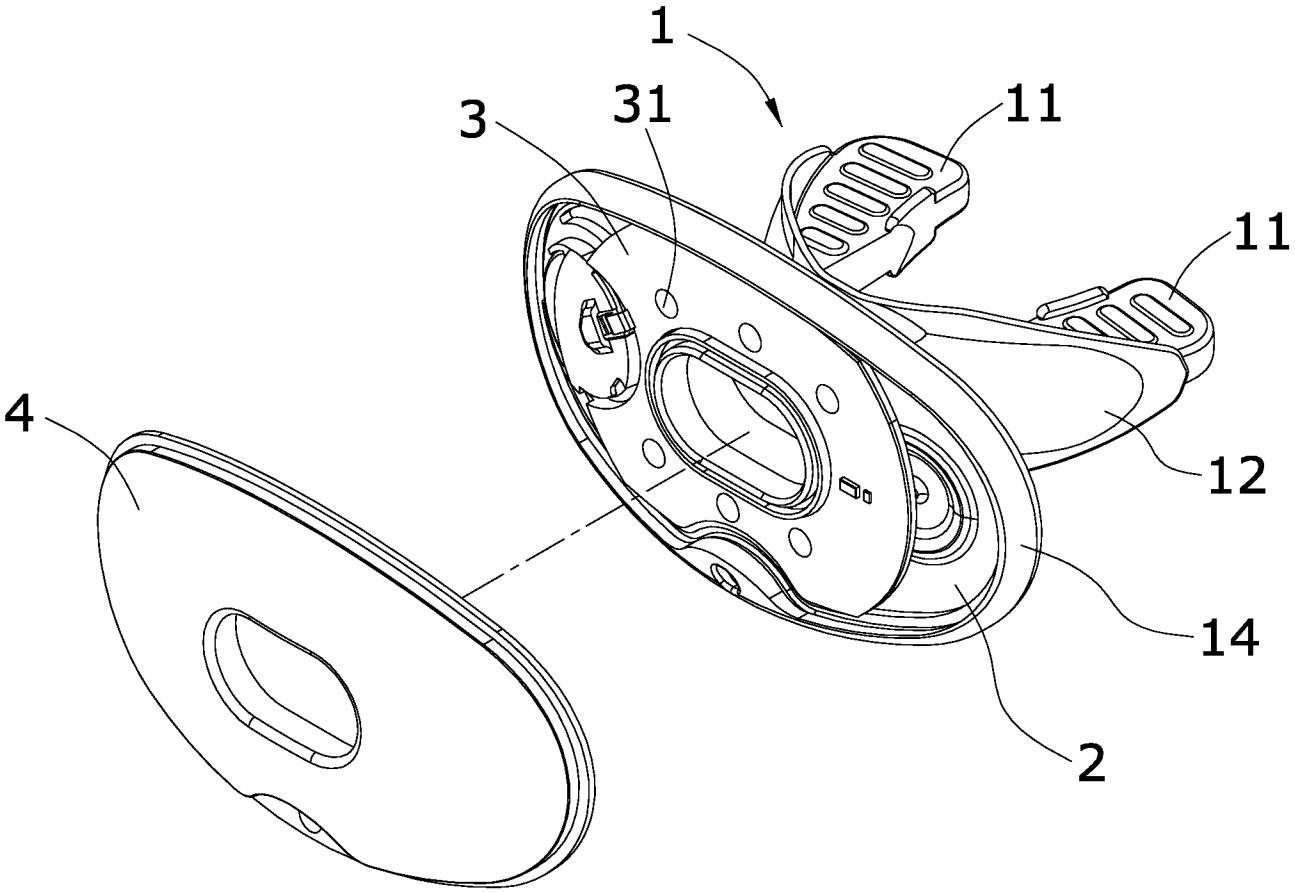
FIG. 3 shows a local assembly and exploded view of the mouthguard with light emitting function, according to the present invention.
Figure 4:
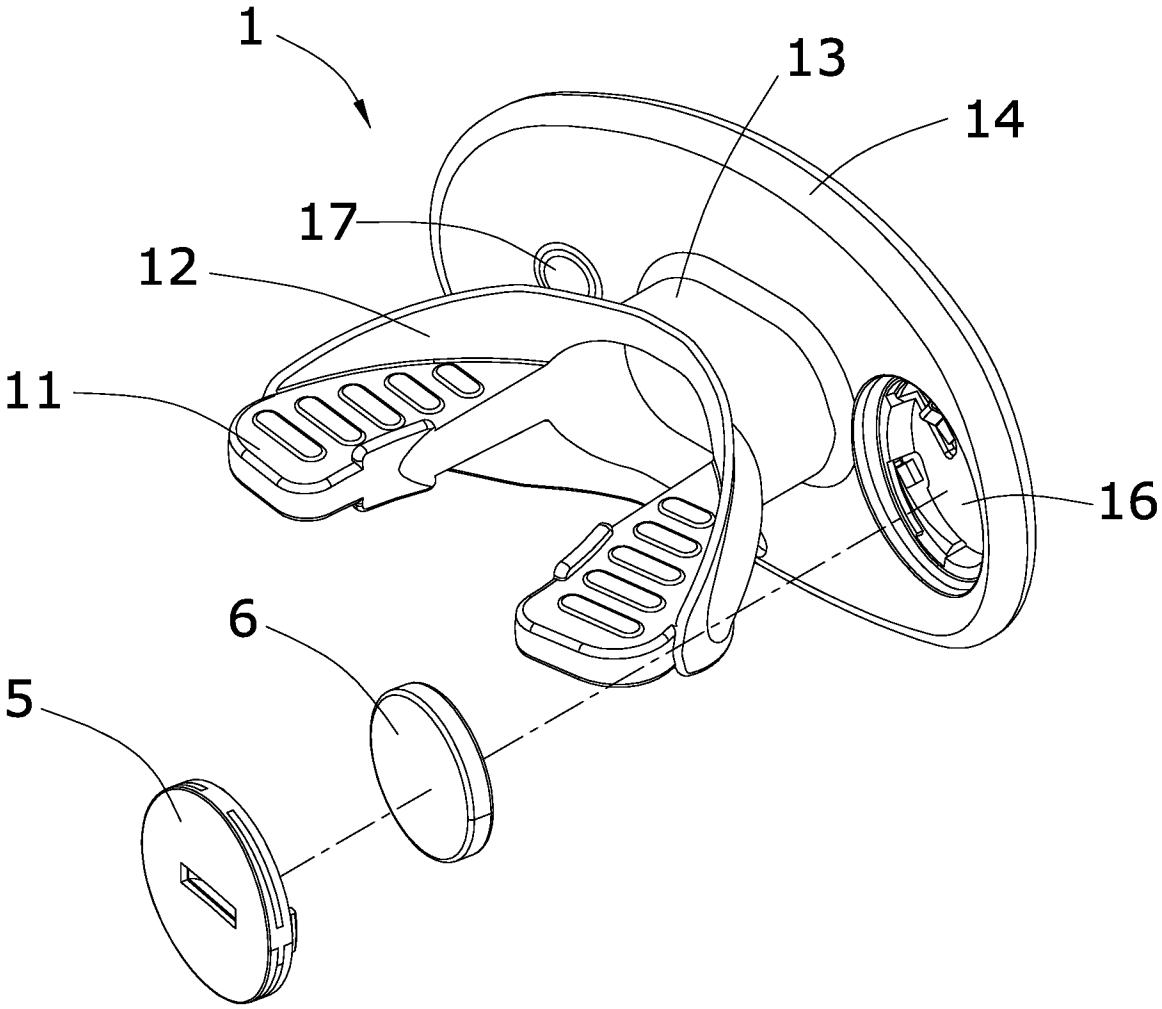
FIG. 4 shows another local assembly and exploded view of the mouthguard with light emitting function, according to the present invention.
Figure 5:
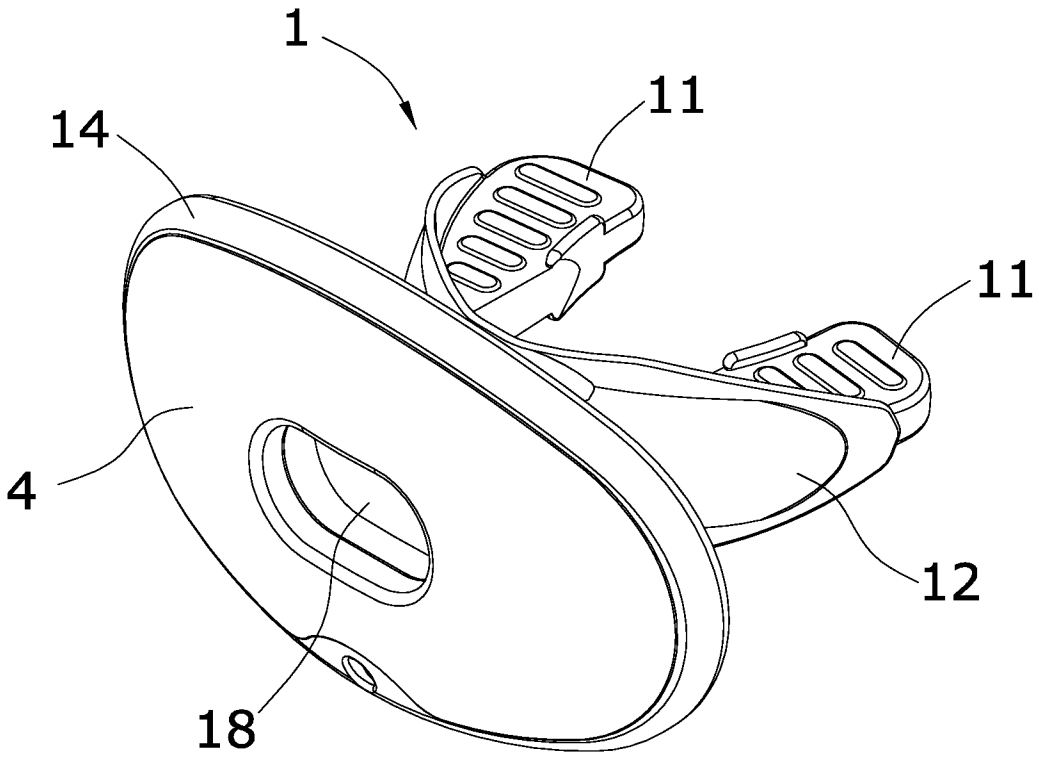
FIG. 5 shows a three-dimensional view of the mouthguard with light emitting function, according to the present invention.
Figure 6:
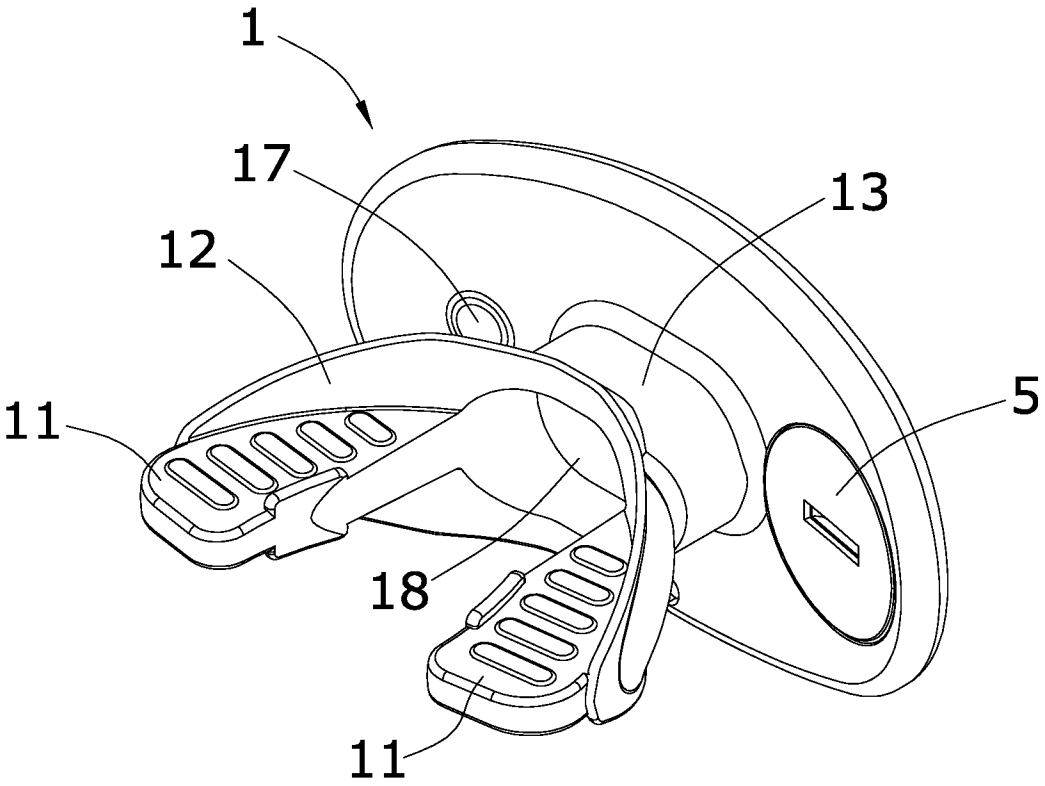
FIG. 6 shows a three-dimensional view of the mouthguard with light emitting function from another angle, according to the present invention.
Figure 7:
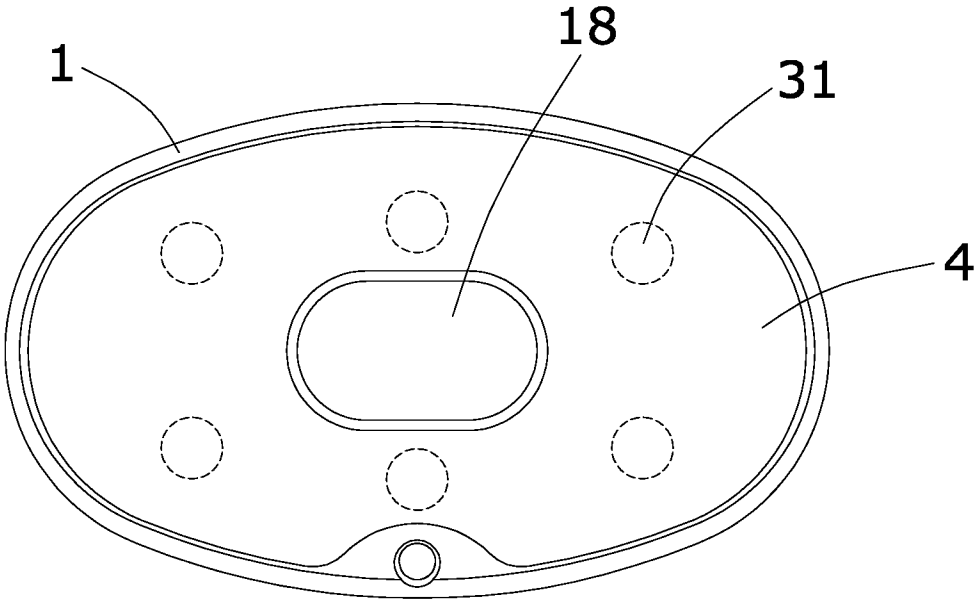
FIG. 7 shows a schematic view of implementation of the mouthguard with light emitting function, according to the present invention.

Referring to FIGS. 1 to 7, a mouthguard with light emitting function, according to the present invention, provides for a wearer to bite by the teeth between the maxilla and the mandible. The mouthguard with light emitting function comprises an occlusion unit 1, a lower cap 2, an electric module 3, an upper cap 4, a battery cover 5, and a battery 6.

The occlusion unit 1 is constituted by a pair of occlusion part 11. The occlusion part 11 is a plate in a thickness, and a front end of the occlusion part 11 is provided with an outer baffle 12, forming respectively an upper brace and a lower brace on the upper side and the lower side between the outer baffle 12 and the occlusion part 11, for biting by the wearer. In addition, a front end of the outer baffle 12 is extended with an extension part 13 which is connected with a protector 14, forming a gap between the protector 14 and the outer baffle 12 through the extension part 13 to accommodate the wearer's lips. A front end of the protector 14 is formed with a holding chamber 15, and two sides in the holding chamber 15 are provided respectively with a perforation 16 and a pressing part 17. More specifically, the perforation 16 and the pressing part 17 are disposed respectively on a side of the extension part 13; whereas, a center location of the extension part 13 is provided with a respiration opening 18 which penetrates the extension part 13, allowing the wearer to respire outward from the center location of occlusion part 11.

The lower cap 2 is disposed in the holding chamber 15 of the protector 14, and a center location of the lower cap 2 is provided with a through hole 21, allowing the lower cap 2 to be sheathed on the extension part 13 of the occlusion unit 1. Two sides of the lower cap 2 are provided respectively with an elastic button 22 and a fixing hole 23. After the lower cap 2 is disposed in the holding chamber 15, the elastic button 22 is disposed relative to the pressing part 17 of the occlusion unit 1; whereas, the fixing hole 23 is disposed relative to the perforation 16 of the occlusion unit 1.

The electric module 3 is disposed in the lower cap 2 and includes a control circuit (not shown in the drawings) and plural light emitting devices 31. Two sides of the electric module 3 are provided respectively with a push button 32 and a battery chamber 33, so that the push button 32 is disposed relative to the elastic button 22 of the lower cap 2, and the battery chamber 33 is disposed relative to the fixing hole 23 of the lower cap 2, after disposing the electric module 3.

The upper cap 4 covers on the lower cap 2 to be combined and fixed with each other. In the present embodiment, the upper cap 4 and the lower cap 2 are combined and fixed together by ultrasonic welding. However, it is worth mentioning that the combination is not limited to this method.

The battery cover 5 is disposed in the fixing hole 23 from the perforation 16 of the occlusion unit 1. The battery cover 5 rotates clockwise or counterclockwise to separate from or to be fixed on the occlusion unit 1.

The battery 6 is disposed in the battery chamber 33 to provide electricity needed by the electric module 3.

After the wearer bites on the occlusion unit 1, his or her lips are disposed in the gap between the outer baffle 12 and the protector 14, so that the wearer's mouth can be protected by the protector 14; whereas, the wearer can inhale and exhale through the respiration opening 18. On the other hand, the wearer can even press the pressing part 17 on the protector 14 to press the elastic button 22 jointly, thereby activating the light emitting devices 31 on the electric module 3 to emit light, thereby achieving the effect of alerting.

In the present embodiment, the electric module 3 is a circuit board and is provided respectively with a control circuit, the light emitting devices 31 and the push button 32, to control the on and off of the light emitting devices 31. However, the electric module 3 does not have to use the circuit board to control the light emitting device 31. Instead, the push button 32 and the light emitting devices 31 can be just disposed between the upper cap 4 and the lower cap 2 and are interconnected together through wirings, and this also achieves the effect of controlling the on or off of the light emitting devices 31.

On the other hand, as the tightening and loosening between the battery cover 5 and the battery chamber 33 are the same as that of conventional structures, no further description is needed in the present embodiment.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A mouthguard with light emitting function, comprising:

an occlusion unit, which is constituted by a pair of occlusion parts, with that a front end of the occlusion parts are formed with an outer baffle, an upper brace and a lower brace are formed respectively on an upper side and a lower side between the outer baffle and the occlusion unit, a front end of the outer baffle is extended with an extension part, the extension part is connected with a protector, a front end of the protector is formed with a holding chamber, two sides in the holding chamber are provided respectively with a perforation and a pressing part, and a center location of the extension part is provided with a respiration opening which penetrates the extension part;

a lower cap, which is disposed in the holding chamber of the protector, with that a center location of the lower cap is provided with a through hole to be sheathed on the extension part of the occlusion unit, and a fixing hole is disposed next to the through hole, corresponding to the perforation of the protector;

an electric module, which is disposed in the lower cap and includes a push button and a light emitting device;

an upper cap, which covers on the lower cap to be combined and fixed with the lower cap; and a battery cover, which is disposed in the fixing hole from the perforation of the occlusion unit.

2. The mouthguard with light emitting function, according to claim 1, wherein the battery chamber accommodates a battery to provide electricity needed by the electric module.

3. The mouthguard with light emitting function, according to claim 1, wherein the perforation and the pressing part of the protector are disposed respectively on a side of the extension part.

4. The mouthguard with light emitting function, according to claim 1, wherein an elastic button is disposed next to the through hole of the lower cap, corresponding to the pressing part of the occlusion unit.

5. The mouthguard with light emitting function, according to claim 4, wherein the electric module includes a control circuit and plural light emitting devices, two sides of the electric module are provided respectively with a push button and a battery chamber, such that the push button is disposed relative to the elastic button of the lower cap, and the battery chamber is disposed relative to the fixing hole of the lower cap, after disposing the electric module.

* * * * *